US008647139B2

(12) United States Patent
Chung et al.

(10) Patent No.: US 8,647,139 B2
(45) Date of Patent: Feb. 11, 2014

(54) ELECTRICAL CONNECTOR FOR DIGITAL BAND

(75) Inventors: Gi Soo Chung, Seoul (KR); Hyun Sub Park, Gyeonggi-do (KR)

(73) Assignee: Korea Institute of Industrial Technology, Chungcheongnam-do (KR)

( * ) Notice: Subject to any disclaimer, the term of this patent is extended or adjusted under 35 U.S.C. 154(b) by 0 days.

(21) Appl. No.: 13/322,590

(22) PCT Filed: Dec. 30, 2010

(86) PCT No.: PCT/KR2010/009561

§ 371 (c)(1),
(2), (4) Date: Nov. 28, 2011

(87) PCT Pub. No.: WO2012/091200

PCT Pub. Date: Jul. 5, 2012

(65) Prior Publication Data

US 2013/0267111 A1 Oct. 10, 2013

(51) Int. Cl.
*H01R 4/50* (2006.01)
*H01R 13/625* (2006.01)

(52) U.S. Cl.
USPC ..... 439/344; 439/492; 439/607.45

(58) Field of Classification Search
USPC ..... 439/344, 497, 499, 607.41, 607.42, 439/607.45, 607.49, 492, 493
See application file for complete search history.

(56) References Cited

U.S. PATENT DOCUMENTS

| | | | | |
|---|---|---|---|---|
| 6,659,800 | B1 * | 12/2003 | Wu | 439/607.11 |
| 6,685,501 | B1 * | 2/2004 | Wu et al. | 439/497 |
| 6,716,057 | B1 * | 4/2004 | Wu | 439/497 |
| 7,794,273 | B2 * | 9/2010 | Xu et al. | 439/555 |
| 7,896,689 | B1 * | 3/2011 | Su et al. | 439/497 |
| 8,047,865 | B2 * | 11/2011 | Patel et al. | 439/499 |
| 8,267,718 | B2 * | 9/2012 | Straka et al. | 439/497 |
| 8,403,698 | B2 * | 3/2013 | Su et al. | 439/455 |
| 2009/0197459 | A1 * | 8/2009 | Yu et al. | 439/497 |
| 2010/0029104 | A1 * | 2/2010 | Patel et al. | 439/76.1 |

FOREIGN PATENT DOCUMENTS

| | | | |
|---|---|---|---|
| KR | 10-2004-0087772 | A | 10/2004 |
| KR | 10-0772591 | B1 | 11/2007 |
| KR | 10-2010-0025808 | A | 3/2010 |

OTHER PUBLICATIONS

International Search Report mailed Sep. 27, 2011 for PCT/KR2010/009561.
Written Opinion of the International Search Report mailed Sep. 27, 2011 for PCT/KR2010/009561.

* cited by examiner

*Primary Examiner* — Hae Moon Hyeon

(57) ABSTRACT

Disclosed is a connector for a digital band, which is attached to the digital band and is quickly and easily attachable to an external circuit. The connector for a digital band includes a body portion having one end attached to the digital band, and at least one conductive portion connected to the digital yarn, and an insertion portion attached to the other end of the body portion and having at least one land connected to the conductive portion and exposed to the outside.

20 Claims, 3 Drawing Sheets

ELECTRICAL CONNECTOR FOR DIGITAL BAND

This application is the National Stage application of International Application No. PCT/KR2010/009561, filed Dec. 30, 2010, which designates the United States and was published in Korean. The International Application No. PCT/KR2010/009561 is hereby incorporated by reference in its entirety into the present application.

TECHNICAL FIELD

The present invention relates to a connector for a digital band.

BACKGROUND ART

In the ubiquitous era, it has been demanded to communicate information by accessing a network in real time everywhere and every time. Accordingly, a digital garment worn by human is required to be connected to the near network and perform such a function. As a result, a digital yarn has been used because the digital yarn can conduct electrons so as to send information and can be woven and knitted to make clothes.

The digital yarn has been conventionally connected to a connector piece by piece. However, there have been several problems that the digital yarn should be arranged at a pitch interval of the connector and the digital yarn should be connected to the connector piece by piece. Thus, it takes a very long process time and the efficiency may be lowered, increasing the cost. In addition, since the digital yarn has a small diameter, it is difficult to connect the digital yarn to a connector, and the digital yarn may be cut off during a weaving or knitting process.

In order to solve such problems, digital bands, in which digital yarns are bound to be coupled with each other, are developed. The digital bands become a substitute for solving the above-described problems of the digital yarns. In order to apply such digital bands to a real product, a connector electrically connecting an external circuit and the digital bands to each other is necessary.

DISCLOSURE OF INVENTION

Technical Proble

The present invention provides a connector for a digital band, which is attached to the digital band and is quickly and easily attachable to an external circuit.

Technical Solution

According to an aspect of the invention, there is provided a connector for a digital band, which is coupled to the digital band including at least one digital yarn, the connector including a body portion having one end attached to the digital band, and at least one conductive portion connected to the digital yarn, and an insertion portion attached to the other end of the body portion and having at least one land connected to the conductive portion and exposed to the outside.

Here, a width of the body portion may correspond to that of the digital band. MOW In addition, the connector may further include a protrusion portion formed on one surface of the body portion to be connected to an external circuit.

The connector may further include an external signal line formed on one surface of the body portion to protrude to the outside.

The external signal line may be electrically connected to the at least one of the at least one conductive portion.

In addition, the external signal line may receive a ground signal from the digital band.

The land may include a plurality of lands arranged along the width of the body portion.

The insertion portion may have a width smaller than that of the body portion.

The digital yarn may include a coating portion surrounding outer circumferential edges of the metal portion and the metal portion.

An end of the metal portion may be electrically connected to the conductive portion of the body portion.

Advantageous Effects

In the connector for a digital band according to the present invention, a conductive portion is provided within a body portion to which the digital band is attached, so that the digital band is electrically connected, and a land is provided in an insertion portion connected to the body portion to be electrically connected to the conductive portion, thereby allowing the digital band to be easily attached to an external circuit through the conductive portion and the land.

In addition, the connector for a digital band according to the present invention includes an external signal line protruding from a bottom surface of the body portion, thereby allowing a ground signal to be stably applied to an external circuit through the digital band.

BEST MODE FOR CARYING OUT THE INVENTION

Hereinafter, embodiments of the present invention will be described in detail with reference to the accompanying drawings such that they can easily be made and used by those skilled in the art.

Hereinafter, a connector for a digital band according to an embodiment of the present invention will be described with reference to FIGS. 1 through 4.

Figure 1:
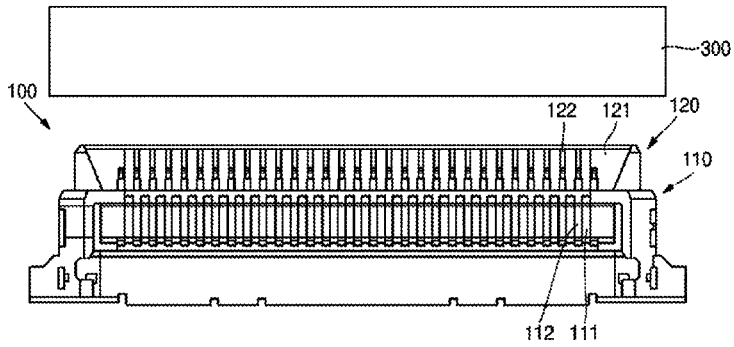
FIG. 1 is a plan view of a connector for a digital band according to an embodiment of the present invention.
Figure 2:
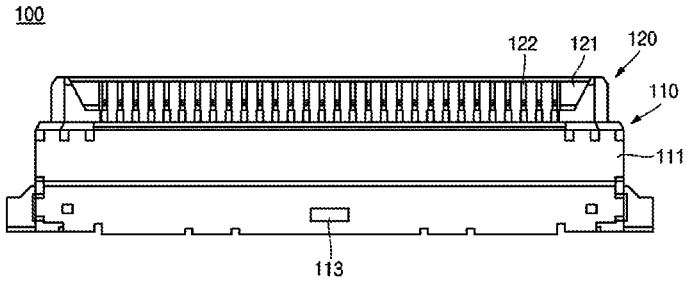
FIG. 2 is a rear view of the connector for a digital band shown in FIG. 1.
Figure 3:
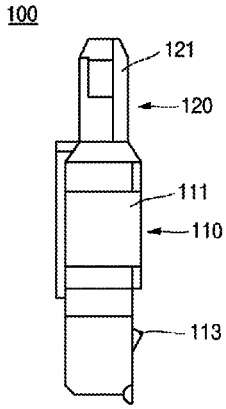
FIG. 3 is a side view of the connector for a digital band shown in FIG. 1.
Figure 4:
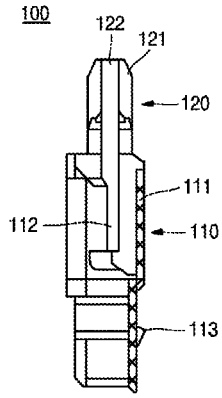
FIG. 4 is a cross-sectional view of the connector for a digital band shown in FIG. 1.

FIG. 1 is a plan view of a connector for a digital band according to an embodiment of the present invention, FIG. 2 is a rear view of the connector for a digital band shown in FIG. 1, FIG. 3 is a side view of the connector for a digital band shown in FIG. 1, and FIG. 4 is a cross-sectional view of the connector for a digital band shown in FIG. 1.

Referring to FIGS. 1 through 4, the connector 100 for a digital band according to the embodiment of the present invention includes a body portion 110 and an insertion portion 120.

The body portion 110 includes a body case 111 forming an exterior shape of the body portion 110, a conductive portion 112 formed within the body case 111, and a protrusion portion 113 formed on a bottom surface of the body case 111.

The body case 111 is elongated in one direction. A length of the body case 111 may correspond to a width of the digital band coupled thereto. The body case 111 may have an internal space so that the conductive portion 112 is patterned and formed therein. In addition, the body case 111 has a space in the opposite direction of the insertion portion 120 to allow the digital band to be positioned in the space and to be connected to the conductive portion 112. In addition, the body case 111 is coupled to a flexible digital band to fix the exterior shape of the digital band, thereby facilitating attachment of the digital band with an external circuit 300. The body case 111 is made of an electrically insulating material, for example, plastic resin. When the digital band connector 100 according to the embodiment of the present invention is connected to the external circuit, a rear end of the body case 111 protrudes outside of the external circuit. The rear end of the body case 111 is gripped by a user, so that the user easily attach/detach the digital band connector 100 to/from the external circuit.

The conductive portion 112 is positioned within the body case 111. The conductive portion 112 includes a plurality of conductive portions provided within the body case 111 and coupled to a digital band (not shown). To this end, the digital band is coupled to the body case 111 in the opposite direction of the insertion portion 120. A configuration of the digital band will later be described. The conductive portion 112 forms a path for transmitting an electrical signal of the digital band to the outside of the insertion portion 120 and transmitting an electrical signal of the insertion portion 120 to the digital band. The conductive portion 112 may be made of a conductor metal having high conductivity, for example, copper, silver, gold, or the like.

The protrusion portion 113 is formed on a bottom surface of the body case 111. The protrusion portion 113 is coupled to the external circuit when the body case 111 is coupled to the external circuit. Thus, the body case 111 and the external circuit can be maintained at a coupled state due to a coupling force of the protrusion portion 113. The protrusion portion 113 may be formed to be elastic for being attachable to the external circuit.

The insertion portion 120 is formed along one side of the body portion 110. In particular, the insertion portion 120 is formed to protrude along the longer side in a lengthwise direction of the body portion 110. When the digital band connector 100 according to the embodiment of the present invention is connected to the external circuit, the insertion portion 120 is inserted into a region corresponding to the external circuit.

The insertion portion 120 includes an insertion case 121 connected to the body case 111 of the body portion 110, and a land 122 formed within the insertion case 121.

The insertion case 121 is formed along the body case 111. A width and length of the insertion case 121 have smaller than those of the body case 111. Accordingly, the insertion case 121 is inserted into the external circuit, and the body case 111 is coupled to the external circuit while it protrudes to the outside of the external circuit. Like the body case 111, the insertion case 121 is made of plastic resin. The insertion case 121 has an internal space to be connected to the land 122 and prevents the land 122 from being disconnected from its adjacent land.

The land 122 is provided within the insertion case 121. The land 122 is coupled to the conductive portion 112 of the body portion 110. The land 122 is exposed to the outside of the insertion case 121 to then be connected to the external circuit. Thus, the conductive portion 112 of the body portion 110 and the land 122 of the insertion portion 120 form an electrical connection path between the digital band and the external circuit.

As described above, in the digital band connector 100 according to the embodiment of the present invention, the conductive portion 112 is provided in the body portion 110 coupled with the digital band to allow the digital band to be electrically connected, and the land 122 is provided in the insertion portion 120 connected to the body portion 110 to allow the land 122 to be electrically connected with the conductive portion 112, thereby easily attach the digital band to the external circuit through the conductive portion 112 and the land 122.

Hereinafter, a connector for a digital band according to another embodiment of the present invention will be described.

Figure 5:
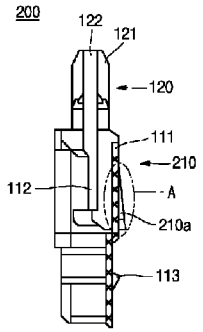
FIG. 5 is a cross-sectional view of a connector for a digital band according to another embodiment of the present invention.
Figure 6:
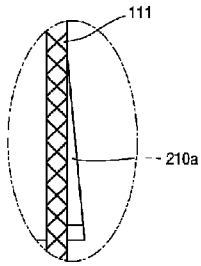
FIG. 6 is an enlarged view of an 'A' portion of FIG. 5.

FIG. 5 is a cross-sectional view of a connector for a digital band according to another embodiment of the present invention, and FIG. 6 is an enlarged view of an 'A' portion of FIG. 5. The components having the same configurations and operations as those of the previous embodiment are denoted by the same reference numerals, and the following description will focus on differences.

Referring to FIGS. 5 and 6, the connector 200 for a digital band according to the embodiment of the present invention includes a body portion 210 and an insertion portion 120.

The body portion 210 includes an external signal line **210*a* formed on a bottom surface of a body case 111. The external signal line 210*a* is separately provided to protrude downward with respect to the body case 111, and is connected to a conductive portion 112 in the case 111. In addition, the external signal line 210*a* is directly connected to an external circuit. Thus, the external signal line 210*a*** may stably apply a ground signal to the external circuit through the digital band.

Hereinafter, a digital band connected to the connector for a digital band according to an embodiment of the present invention will be described.

Figure 7:
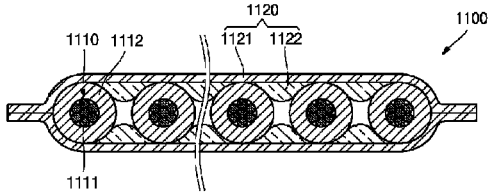
FIG. 7 is a cross-sectional view of a digital band connected to the connector for a digital band shown in FIG. 1.

FIG. 7 is a cross-sectional view of a digital band connected to the connector for a digital band shown in FIG. 1.

A digital band 1100 means a band formed by binding a plurality of digital yarns 1110 together. The digital band 1100 is attached to a digital garment and serves as a circuit by connecting input port and an output port of an electronic module so as to provide a communication path.

The digital yarn 1110 includes a metal portion 1111 made of castings and having a substantially circular shape and a coating portion 1112 having a substantially circular shape and surrounding the metal portion 1111 with a resin material. The metal portion 1111 is made of metal that has low electrical resistance and high elastic restoring force against repeated bending, for example, copper, copper alloy, silver, silver alloy, gold, gold alloy, brass, or equivalents thereof. The coating portion 1112 shields external noise to be used for high-speed communication, and may be made of any one selected from ETFE (Ethylenetetrafluoroethylene), FEP (Fluorinated Ethylenepropylene), PTFE (Polytetrafluoroethylene), PVDF (Polyvinylidenefluoride), PFA (Perfluoroalkoxy) and its equivalents, but not limited thereto. In the digital yarns 1110, an end of the metal portion 1111 is exposed to be electrically connected to the conductive portion 112 of the digital band connector 100 or 200. Therefore, the digital yarns 1110 may transmit/receive electrical signals to/from an external circuit through the digital band connector 100 or 200.

A tape 1120 is formed to surround the digital yarns 1110. The tape 1120 is formed of a pair of upper and lower tapes that are symmetrical to each other. The upper and lower tapes are attached to each other with the digital yarns 1110. The tape 1120 binds the plurality of digital yarns 1110 together. The tape 1120 includes a surface portion 1121 forming an outer part, and an adhesive portion 1122 formed inside the surface portion 1121. The surface portion 1121 forms the outer part of the tape 1120 and is not adhesive. The surface portion 1121 may be formed of polyurethane, PTFE (polytetra fluoroethylene), or PVC (polyvinyl chloride). The adhesive portion 1122 is formed inside the surface portion 1121 and is adhesive. In addition, the plurality of digital yarns 1110 are sealed and fixed by attaching adhesive portion 1122 on the surface of the digital yarns 1110. The adhesive portion 1122 may be formed of any one selected from polyurethane, nylon and polyester resin, or mixtures thereof.

Figure 8:
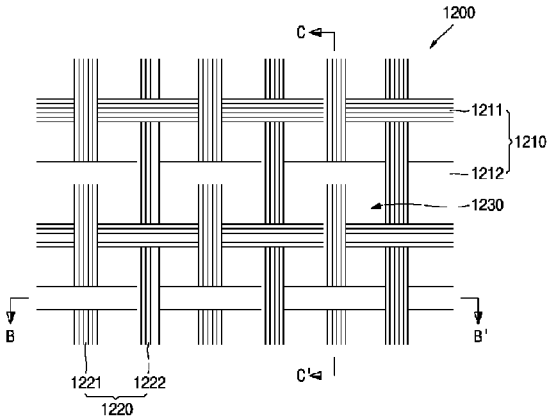
FIG. 8 is a plan view of a garment-type digital band according to another embodiment of the present invention connected to the connector for a digital band shown in FIG. 1.
Figure 9:
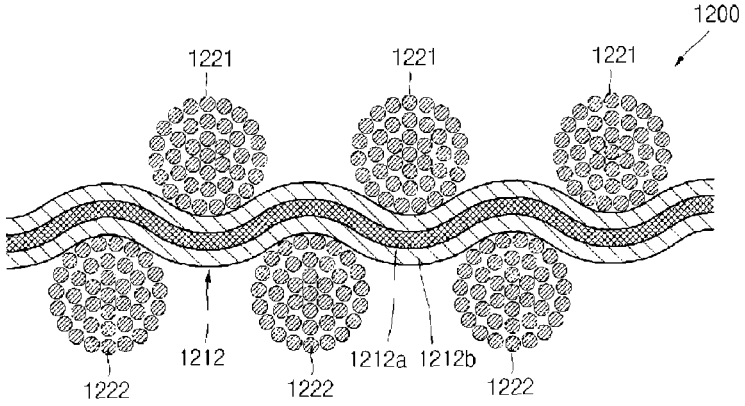
FIG. 9 is a cross-sectional view taken along the line B-B' of FIG. 8.
Figure 10:
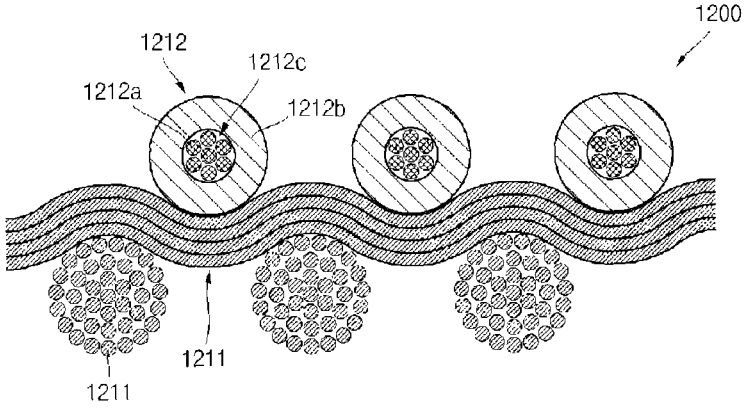
FIG. 10 is a cross-sectional view taken along the line C-C' of FIG. 8.

FIG. 8 is a plan view of a garment-type digital band according to another embodiment of the present invention connected to the connector for a digital band shown in FIG. 1, FIG. 9 is a cross-sectional view taken along the line B-B' of FIG. 8, and FIG. 10 is a cross-sectional view taken along the line C-C' of FIG. 8.

The digital band 1200 includes a plurality of warps 1210 and a plurality of woofs 1220 arranged perpendicular to the plurality of warps 1210.

The warps 1210 are arranged in parallel to each other in a first direction with predetermined gaps in a second direction perpendicular to the first direction. The warps 1210 include a plurality of normal warps 1211 and digital yarns 1212 that are arranged in the second direction.

The normal warp 1211 is formed of yarns. The yarn means threads to constitute fabric of clothes.

The digital yarn 1212 includes a metal portion 1212*a*, a coating portion 1212*b*, and a pore 1212*c* formed between the coating portion 1212*b* and the metal portion 1212*a*. The metal portion 1212*a* and the coating portion 1212*b* are substantially the same as those of the previous embodiment of the present invention.

The woofs 1220 are formed in plural number in the second direction perpendicular to the warps 1210 and are weaved with the warps 1210, thereby forming the digital band 1200. The woofs 1220 include two groups, that is, first and second woofs 1221 and 1222 according to the arrangement row.

Figure 11:
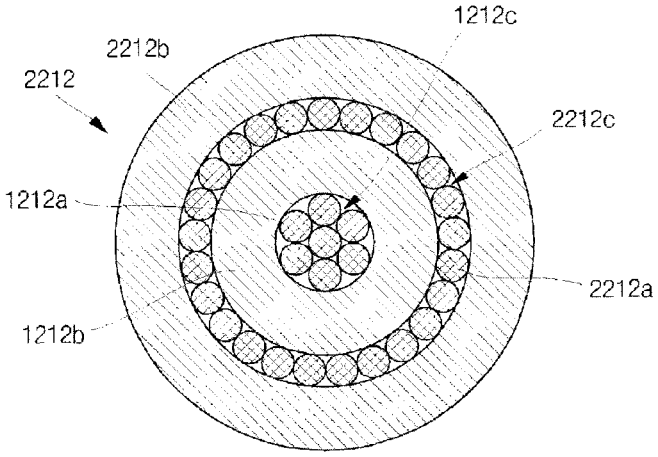
FIG. 11 is a cross-sectional view illustrating additional component of a digital yarn of a digital band.

FIG. 11 is a cross-sectional view illustrating additional component of a digital yarn of a digital band.

Referring to FIG. 11, the digital yarn 2212 includes a metal portion 1212*a*, a coating portion 1212*b*, an outer metal portion 2212*a* arranged with equal gaps along the outer circumference edge of the coating portion 1212*b*, and an outer coating portion 2212*b* surrounding the outer metal portion 2212*a*.

In addition, a pore 1212*c* may be formed between the metal portion 1212*a* and the coating portion 1212*b*, and a pore 2212*c* may also be formed between each of the coating portion 1212*b*, the outer metal portion 2212*a* and the outer coating portion 2212*b*.

The outer metal portion 2212*a* is arranged with equal gaps along the outer circumference edge of the coating portion 1212*b*. In addition, the outer metal portion 2212*a* may be tightly arranged to surround the circumference of the coating portion 1212*b*.

The outer metal portion 2212*a* shield human body from electromagnetic wave generated by current flowing through the metal portion 1212*a*. In addition, the outer metal portion 2212*a* shield the metal portion 1212*a* from external electromagnetic wave noise.

The outer metal portion 2212*a* is made of the same material as the metal portion 1212*a* and formed outside the metal portion 1212*a* so as to have a sectional surface wider than a sectional surface of the metal portion 1212*a*. Accordingly, the outer metal portion 2212*a* can easily absorb electromagnetic wave generated from the metal portion 1212*a* and the external electromagnetic wave noise. As a result, the outer metal portion 2212*a* can improve electromagnetic wave shielding function of the coating portion 1212*b*.

The outer coating portion 2212*b* is formed to surround the outside of the outer metal portions 2212*a*. The outer coating portion 2212*b* is formed of the same material as the coating portion 1212*b* so as to intercept electromagnetic wave generated from the metal portion 1212*a* and the external electromagnetic wave noise.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

INDUSTRIAL APPLICABILITY

In the digital band connector according to the present invention, a conductive portion is provided inside a body portion coupled with the digital band to allow the digital band to be electrically connected, and a land is provided in an insertion portion connected to the body portion to allow the land to be electrically connected with the conductive portion, thereby easily attach the digital band to an external circuit through the conductive portion and the land.

In addition, in the digital band connector according to the present invention, an external signal line protruding from a bottom surface of the body portion is provided, thereby allowing a ground signal to be stably applied to an external circuit through the digital band.

What is claimed is:

1. A connector for a digital band, which is coupled to the digital band, wherein the digital band comprises a plurality of woofs and a plurality of warps, wherein the warps comprise at least one digital yarn, the connector comprising:

a body portion having one end attached to the digital band, and at least one conductive portion connected to the digital yarn; and an insertion portion attached to the other end of the body portion and having at least one land connected to the conductive portion and exposed to the outside.

2. The connector for a digital band of claim 1, wherein a width of the body portion corresponds to that of the digital band.

3. The connector for a digital band of claim 1, further comprising a protrusion portion formed on one surface of the body portion and adapted to be connected to an external circuit.

4. The connector for a digital band of claim 1, further comprising an external signal line formed on one surface of the body portion to protrude to the outside.

5. The connector for a digital band of claim 4, wherein the external signal line is electrically connected to the at least one of the at least one conductive portion.

6. The connector for a digital band of claim 4, wherein the external signal line receives a ground signal from the digital band.

7. The connector for a digital band of claim 1, wherein the land includes a plurality of lands arranged along the width of the body portion.

8. The connector for a digital band of claim 1, wherein the insertion portion has a width smaller than that of the body portion.

9. The connector for a digital band of claim 1, wherein the digital yarn includes a metal portion and a coating portion surrounding outer circumferential edges of the metal portion.

10. The connector for a digital band of claim 9, wherein an end of the metal portion is electrically connected to the conductive portion of the body portion.

11. The connector for a digital band of claim 1, wherein the body portion further includes a body case forming an exterior shape of the body portion and the conductive portion formed within the body case.

12. The connector for a digital band of claim 11, wherein the body case is made of an electrically insulating material.

13. The connector for a digital band of claim 11, further comprising a protrusion formed on a bottom surface of the body case.

14. The connector for a digital band of claim 3, wherein the protrusion portion is formed to be elastic for being adapted to be attached to an external circuit.

15. The connector for a digital band of claim 13, wherein the protrusion portion is formed to be elastic for being adapted to be attached to an external circuit.

16. The connector for a digital band of claim 9, wherein the coating portion comprises a material selected from the group consisting of ethylenetetrafluoroethylene (ETFE), fluorinated ethylenepropylene (FEP), polytetrafluoroethylene (PTFE), polyvinylidenefluoride (PVDF), and perfluoroalkoxy (PFA).

17. The connector for a digital band of claim 9, wherein the coating portion is surrounded by a pair of upper and lower tapes that are symmetrical to each other.

18. The connector for a digital band of claim 11, further comprising an external signal line formed on a surface of the body case.

19. The connector for a digital band of claim 18, wherein the external signal line is provided to protrude downward with respect to the body case.

20. The connector for a digital band of claim 19, wherein the external signal line receives a ground signal from the digital band.

* * * * *